US010786063B2

(12) United States Patent
Park

(10) Patent No.: US 10,786,063 B2
(45) Date of Patent: Sep. 29, 2020

(54) FLOW-THROUGH APPLICATOR DEVICE

(71) Applicant: L'OREAL, Paris (FR)

(72) Inventor: Kyoo Jin Park, Leonia, NJ (US)

(73) Assignee: L'OREAL, Paris (FR)

( * ) Notice: Subject to any disclaimer, the term of this patent is extended or adjusted under 35 U.S.C. 154(b) by 70 days.

(21) Appl. No.: 16/159,242

(22) Filed: Oct. 12, 2018

(65) Prior Publication Data

US 2020/0113307 A1 Apr. 16, 2020

(51) Int. Cl.

| | |
|---|---|
| ***A45D 34/04*** | (2006.01) |
| ***B05C 17/01*** | (2006.01) |
| ***B65D 83/00*** | (2006.01) |
| ***A45D 40/00*** | (2006.01) |

(52) U.S. Cl.

CPC .... *A45D 34/043* (2013.01); *A45D 2040/0025* (2013.01); *A45D 2200/055* (2013.01); *A46B 2200/1053* (2013.01); *B05C 17/01* (2013.01); *B05C 17/0116* (2013.01); *B05C 17/0133* (2013.01); *B65D 83/0016* (2013.01)

(58) Field of Classification Search

CPC ..... A45D 34/043; A45D 2200/1045; A45D 2200/055; A45D 2040/0025; B05C 17/01; B05C 17/0116; B05C 17/0133; A46B 2200/1053; A46B 2200/1046; B65D 83/0005; B65D 83/0011; B65D 83/0016; B65D 83/0022

See application file for complete search history.

(56) References Cited

U.S. PATENT DOCUMENTS

| | | | | |
|---|---|---|---|---|
| 1,919,887 | A | 7/1933 | Gleeson | |
| 4,002,182 | A | 1/1977 | Michel | |
| 4,071,300 | A * | 1/1978 | Nichols | A46B 11/0027 401/175 |
| 4,722,459 | A | 2/1988 | Goncalves | |
| 4,887,924 | A | 12/1989 | Green | |
| 8,206,050 | B2 * | 6/2012 | Prague | A45D 40/26 401/175 |
| 8,506,193 | B1 * | 8/2013 | Zhang | A45D 40/20 222/110 |
| 8,523,474 | B2 * | 9/2013 | Liu | A47K 5/1212 401/175 |

* cited by examiner

*Primary Examiner* — David J Walczak

(74) *Attorney, Agent, or Firm* — Oblon, McClelland, Maier & Neustadt, L.L.P.

(57) ABSTRACT

A flow-through device includes a body, including a stem; a cap; a neck; a piston; and an applicator; and a bottle including a reservoir configured to hold a solution, wherein the piston is attached to the stem at a predetermined distance along a length of the stem away from a bottom face of the reservoir when the stem is inserted into the reservoir, forms a seal with a sidewall of the reservoir, and is configured to displace the solution filled in the reservoir into a hollow channel volume of the stem, an interior applicator volume of the applicator, and an interior cap volume of the cap, and the reservoir is filled with an overfilled volume of the solution filling into the hollow channel volume of the stem, the interior applicator volume of the applicator, and the interior cap volume of the cap.

9 Claims, 3 Drawing Sheets

FLOW-THROUGH APPLICATOR DEVICE

BACKGROUND

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Flow-through devices may be used to apply a solution to surfaces without dipping an applicator into a reservoir. The reservoir may hold the solution and a mechanism may be utilized to move the solution from the reservoir to the device applicator as solution is consumed. The device may go unused for an extended period of time, which may lead to dehydration of the applicator, for example when stored on a retailer's shelf. To prevent this, the flow-through device may be assembled with solution filled in the interior volumes of the features through which solution moves. However, a flow-through device including a cap may require two steps to fill both the cap and the internal features to prevent dehydration of the applicator. Accordingly, an improved device that retains moisture and wetness of an applicator is desired.

SUMMARY

The present disclosure relates to a flow-through device, including: a body, including a stem; a cap; a neck; a piston; and an applicator; and a bottle including a reservoir configured to hold a solution, wherein the cap is removeably attached to a first end of the body adjacent to the neck, configured to cover the applicator when attached, and includes an interior cap volume for the solution to fill, the stem is disposed at a second end of the body and attached to the neck, includes a hollow channel volume for the solution to flow through, and is configured to insert into the reservoir through an opening of the reservoir at a first end of the reservoir; the piston is attached to the stem at a predetermined distance along a length of the stem away from a bottom face of the reservoir when the stem is inserted into the reservoir, forms a seal with a sidewall of the reservoir, and is configured to displace the solution filled in the reservoir into the hollow channel volume of the stem; the applicator is attached to the neck at the first end of the body, includes an interior applicator volume and at least one flow hole configured to excrete the solution pushed through the stem by the piston, and is configured to spread the solution excreted through the at least one flow hole onto a surface; the neck is configured to rotate the attached stem, the rotation causing a movement of the piston along the length direction of the stem; and the reservoir is filled with an overfilled volume of the solution filling into the hollow channel volume of the stem, the interior applicator volume of the applicator, and the interior cap volume of the cap.

The foregoing paragraphs have been provided by way of general introduction, and are not intended to limit the scope of the following claims. The described aspects, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

The description set forth below in connection with the appended drawings is intended as a description of various aspects of the disclosed subject matter and is not necessarily intended to represent the only aspect(s). In certain instances, the description includes specific details for the purpose of providing an understanding of the disclosed subject matter. However, it will be apparent to those skilled in the art that aspects may be practiced without these specific details. In some instances, well-known structures and components may be shown in block diagram form in order to avoid obscuring the concepts of the disclosed subject matter.

Reference throughout the specification to "one aspect" or "an aspect" means that a particular feature, structure, characteristic, operation, or function described in connection with an aspect is included in at least one aspect of the disclosed subject matter. Thus, any appearance of the phrases "in one aspect" or "in an aspect" in the specification is not necessarily referring to the same aspect. Further, the particular features, structures, characteristics, operations, or functions may be combined in any suitable manner in one or more aspects. Further, it is intended that aspects of the disclosed subject matter can and do cover modifications and variations of the described aspects.

It must be noted that, as used in the specification and the appended claims, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "upper," "lower," "front," "rear," "side," "interior," "exterior," and the like that may be used herein, merely describe points of reference and do not necessarily limit aspects of the disclosed subject matter to any particular orientation or configuration. Furthermore, terms such as "first," "second," "third," etc., merely identify one of a number of portions, components, points of reference, operations and/or functions as described herein, and likewise do not necessarily limit aspects of the disclosed subject matter to any particular configuration or orientation.

Figure 1A:
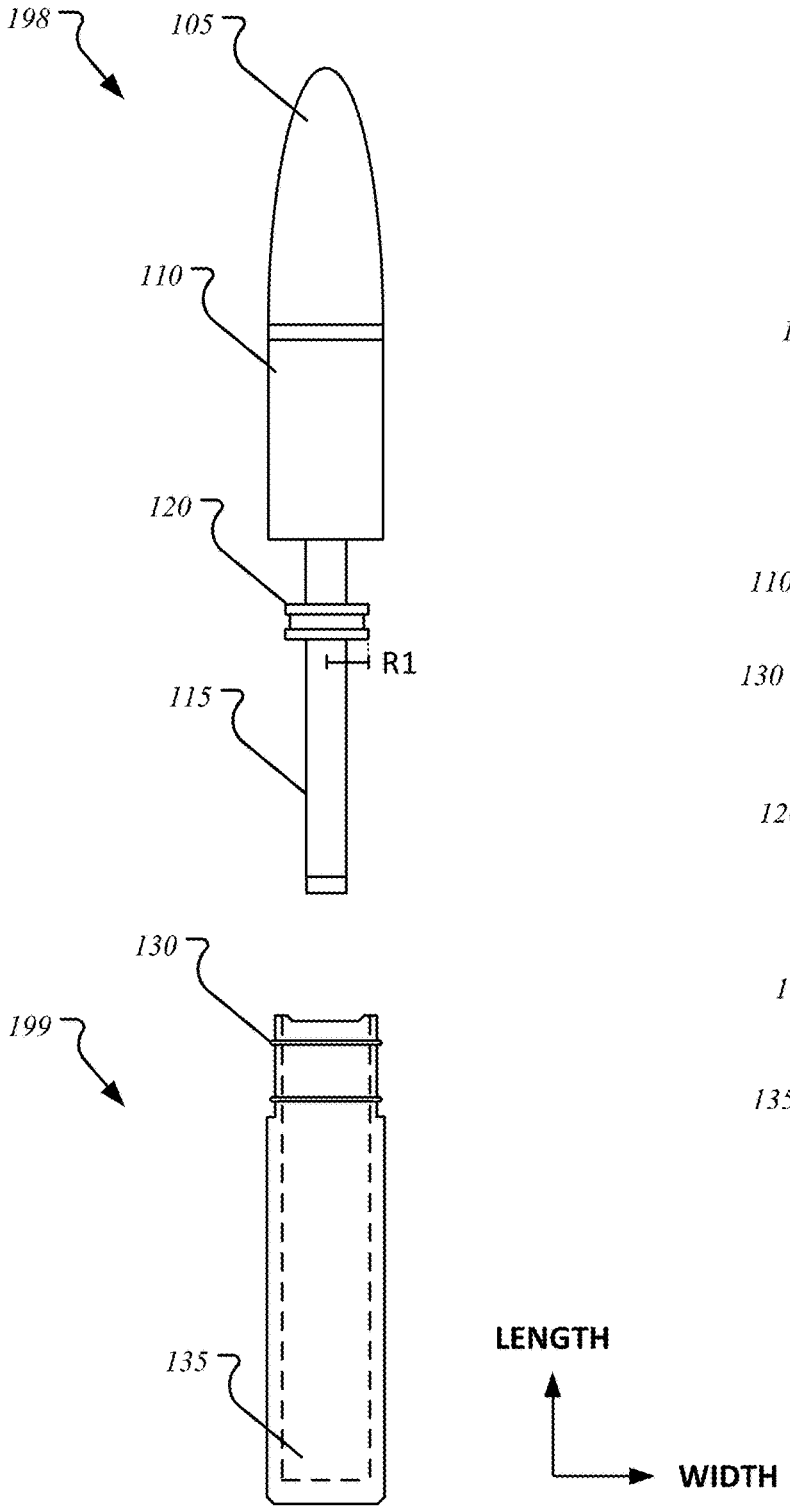
FIG. 1A is a perspective view schematic of a disassembled cosmetic flow-through applicator pen, according to an exemplary aspect of the present disclosure.
Figure 1B:
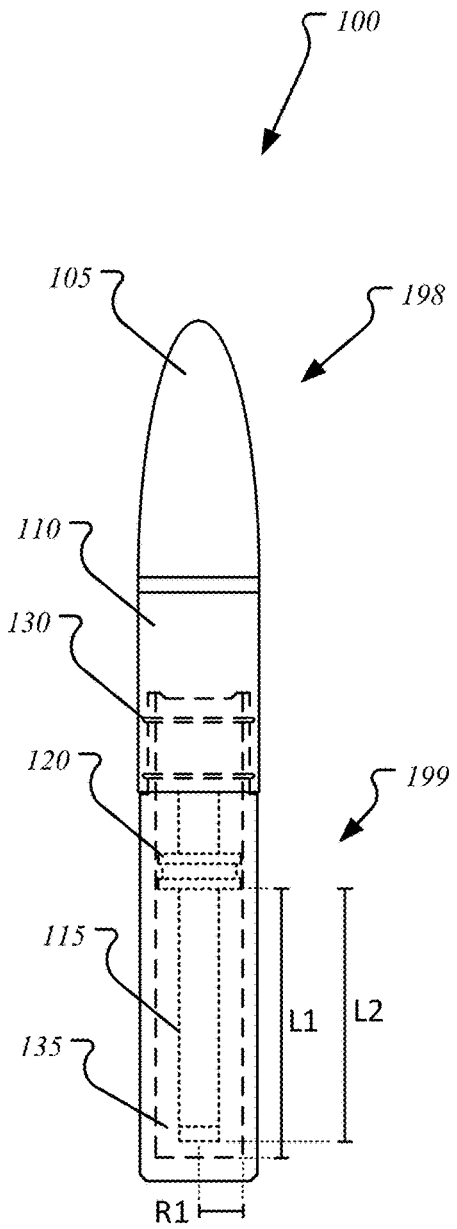
FIG. 1B is a perspective view schematic of an assembled cosmetic flow-through applicator pen, according to an exemplary aspect of the present disclosure.

FIGS. 1A and 1B illustrate schematics of a flow-through cosmetic pen 100, according to an exemplary aspect of the present disclosure. The flow-through cosmetic pen 100 (herein referred to as pen 100) may include a body 198 and a bottle 199. The body 198 may include a cap 105, a neck 110, a stem 115, and a piston 120. The bottle 199 may include a seal 130 and a reservoir 135.

The cap 105 may be disposed at a first end of the body 198 and be connected to the neck 110 when in a closed configuration, wherein the cap 105 may be removed for an open configuration. The portion of the cap 105 in contact with the neck 110 may form a seal with the neck 110 when in the closed configuration. The seal formed may prevent a solution injected into an interior of the cap 105 from leaking out. For example, the cap 105 may be twist-tightened onto the neck 110. The seal formed may prevent foreign materials exterior to the cap 105 from entering into the interior of the cap. Non-limiting examples of methods for closing the cap 105 on the neck 110 include a snap tightening, a screw tightening, or any other method known in the art. The cap 105 may have a conical, cylindrical, rounded (as shown), or flared shape, or any predetermined shape that may hold a predetermined volume of solution in the interior.

The neck 110 may be partially hollow and have an interior with an inner diameter. In one aspect, the stem 115 is attached to a sidewall of the interior of the neck 110. In one aspect, the stem 115 may be a detachable feature, wherein the stem 115 may be inserted into the interior of the neck 110 and mated with a lock. The stem 115 may be removed from the lock when maintenance of the part is desired.

The stem 115 may be disposed at a second end of the body 198 and attached to a side of the neck 110 opposite the cap 105. The stem 115 may be a hollow tube shape and include a first end of the stem 115 disposed towards the first end of the body 198, and a second end of the stem 115 disposed towards the second end of the body 198. The stem 115 may allow flow of the solution from the second end of the stem 115 to the first end of the stem 115. The stem 115 may be attached such that a rotation of the neck 110 may rotate the stem 115. The stem 115 exterior surface may be screw threaded. The piston 120 may be a ring shape with a screw thread in an interior of the piston 120 matching the screw thread of the stem 115. The piston 120 may be mounted on the stem 115 and disposed at a predetermined length L2 along the stem 115 away from the second end of the stem 115. The piston 120 mounted on the stem 115 may form a seal between the interior of the piston 120 and the screw thread of the stem 115.

In one aspect, the body 198 may be inserted into an opening disposed at a first end of the bottle 199, wherein the second end of the stem 115 is inserted first. The first end of the bottle 199 may have an outer diameter substantially equal to or slightly thinner than the inner diameter of the neck 110. The first end of the bottle 199 may be inserted into the interior of the neck 110 and the seal 130 may form a seal with the sidewall of the interior of the neck 110 to prevent leakage. The seal 130 may be made of a deformable material that deforms against the sidewall of the interior of the neck 110 when the first end of the bottle 199 is inserted in the neck 110.

The reservoir 135 may be a predetermined volume of empty space in an interior of the bottle 199 configured to hold a solution. For example, the reservoir 135 may hold mascara. For example, the reservoir 135 may hold ink. For example, the reservoir 135 may hold a solution having non-Newtonian behavior. For example, the reservoir 135 may hold at least one selected from the group consisting of hair gel, eyebrow gel, lip gloss, concealer, liquid blush, and pigmented ink. The predetermined volume may be determined based on a desired quantity of solution for use with the pen 100. The cross-sectional shape (a plane orthogonal to a length direction) of the reservoir 135 may be designed to match the cross-sectional shape of the piston 120. The reservoir 135 may include sidewalls extending along the length direction of the bottle 199 and a bottom face disposed at a second end of the bottle 199. An outer diameter of the piston 120 may be just slightly narrower than an inner diameter of the reservoir 135 and the piston 120 may form a seal between an outer surface of the piston 120 in contact with an interior surface of the reservoir 135 when the piston 120 is inserted into the reservoir 135. The piston 120 may include a lower face, wherein the lower face is the surface of the piston 120 facing towards the second end of the stem 115. The predetermined length L2 along the stem 115 away from the second end of the stem 115 where the piston 120 is mounted on the stem 115 may allow the lower face of the piston 120 to come to rest after being inserted at a predetermined length L1 along the stem 115 away from the bottom face of the reservoir 135.

Figure 2:
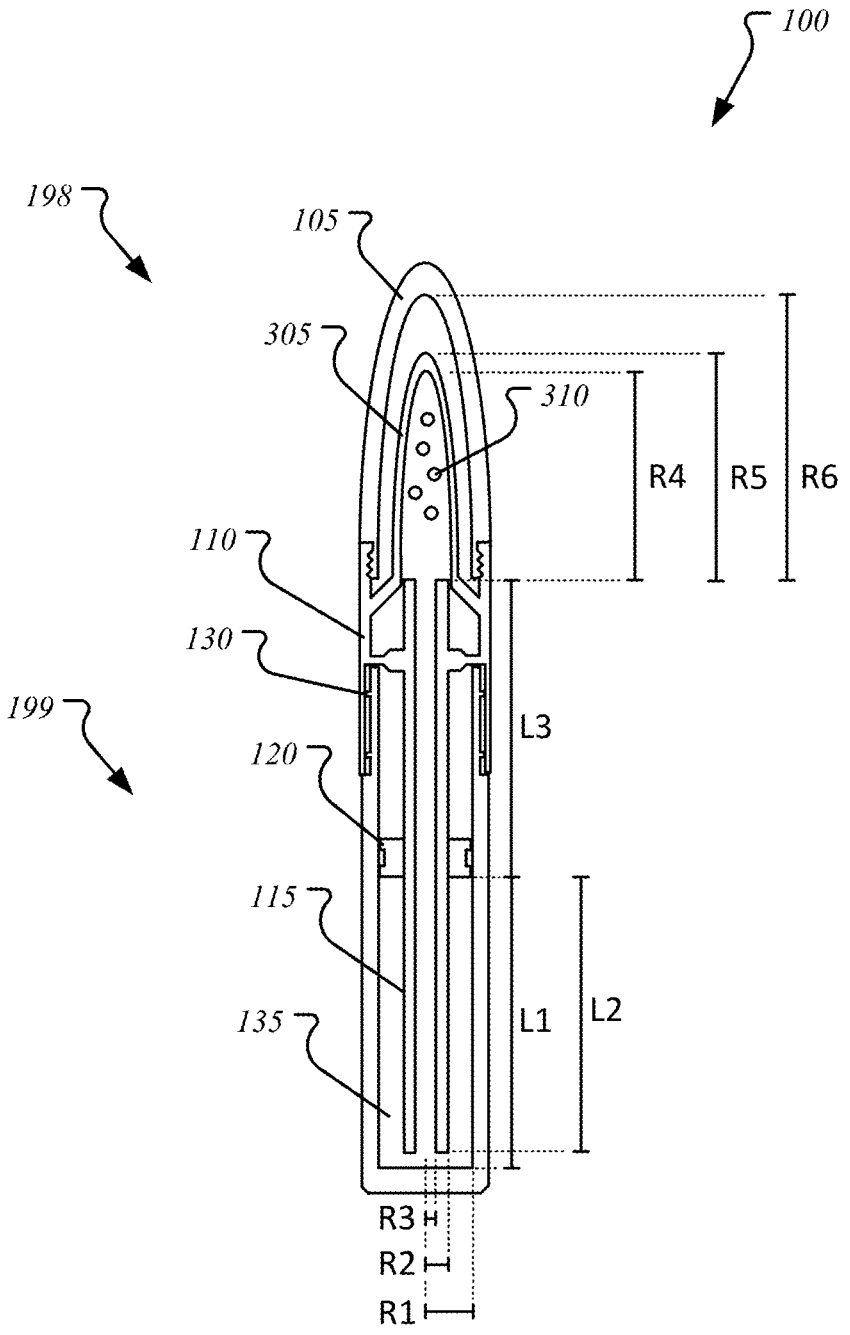
FIG. 2 is a cross-sectional view schematic of a cosmetic flow-through applicator pen, according to an exemplary aspect of the present disclosure.

FIG. 2 illustrates a cross-sectional schematic of a flow-through cosmetic pen 100, according to an exemplary aspect of the present disclosure. In the interior of the cap 105, the body 198 may include an applicator 305 attached at its base to the interior sidewall of the neck 110. The applicator 305 may include at least one flow hole 310 (herein referred to as holes 310). In one aspect, the holes 310 may be disposed on a predetermined side of the applicator 305. In one aspect, the holes may be distributed over the entire surface of the applicator 305. The holes 310 may be configured to excrete the solution received from the stem 115.

The applicator 305 may include a material on an exterior surface of the applicator 305 configured to spread said solution. For example, the material may be flocking adhered to an adhesive coating on the applicator 305 configured to spread lip gloss. For example, the material may be bristles configured to spread ink.

The reservoir 135 may be filled with a predetermined volume of solution, wherein a hollow channel volume of the stem 115, an interior applicator volume of the applicator 305, and an interior cap volume of the cap 105 are at least partially filled when the body 198 is inserted into the bottle 199. The piston 120 may form a seal with the reservoir 135 and push any overfilled solution in the reservoir 135 into the hollow channel volume of the stem 115 and subsequently fill at least partially the interior applicator volume of the applicator 305 and the interior cap volume of the cap 105. The predetermined value may be determined based on the geometry of the stem 115, applicator 305, and cap 105. For example, the stem 115 may be cylindrical with the hollow portion also being cylindrical, the applicator 305 may have an ellipsoid shape, and the cap 105 may have an ellipsoid shape, wherein the applicator 305 and cap 105 are shaped like half of an ellipsoid. Thus, the volume of the extra solution needed to fill the stem 115, applicator 305, and cap 105 may be expressed as the volume of the hollow channel of the stem 115 ($V_{stem}$) that may hold solution plus the interior volume of the applicator 305 ($V_{appl}$) plus the interior volume of the cap 105 ($V_{cap}$), minus the volume of the sidewall of the stem 115 that is submerged in the reservoir 135 ($V_{displaced}$), or $$V_{extra}=V_{stem}+V_{appl}+V_{cap}-V_{displaced}$$

wherein the hollow channel volume of the stem 115 may be given as the volume of a cylinder with radius R3 and length L2+L3, or $V_{stem}=\pi R3^2(L2+L3)$, wherein the interior volume of the applicator 305 may be given as the volume of half an ellipsoid having radii R2 and R4, or $V_{appl}=\frac{2}{3}\pi R2^2R4$, wherein the interior volume of the cap 105 may be given as the volume of half an ellipsoid having radii R1 and R6 minus the volume of the applicator 305 exterior half-ellipsoid having radii R2 and R5, or $V_{cap}=\frac{2}{3}\pi R1^2R6-\frac{2}{3}\pi R2^2R5$, wherein the volume of the sidewall of the stem 115 may be given as the volume of the stem 115 minus the volume of the inner hollow portion, or $V_{displaced}=\pi R2^2L2-\pi R3^2L2$.

Thus, by filling the reservoir 135 with the extra volume of solution, $V_{extra}$, the solution will be pushed by the piston 120 into the stem 115, applicator 305, and cap 105 such that they are filled and no solution is forced out of the cap 105. If the geometry of the specific parts were to change, e.g. the applicator 305 may have a pointed conical shape instead or the cap is rectangular instead, the volume expression for said shape may be used in place of the equations above. It may be appreciated that myriad shapes may be used for the stem 115, applicator 305, and cap 105 depending on the desired applicator or aesthetic appeal of the pen 100. Moreover, it may be appreciated that the aforementioned parts may be filled partially instead of fully.

In one aspect, after joining the body 198 and the bottle 199, the neck 110 may be rotated to spin the thread on the stem 115, which in turn may translate the piston 120 in a direction towards or away from the bottom face of the reservoir 135. When the piston 120 is translated in a direction towards the bottom face of the reservoir 135, the solution in the reservoir 135 may be pushed into the stem 115 to exit out of the applicator 305 via the flow holes 310. The neck 110 may be rotated to translate the piston 120 is partially or entirely down the length of the stem 115 in order to push out some or all of the solution in the reservoir 135 as a user uses said solution.

It may be appreciated that other types of pens 100 may be used with other types of mechanisms for pushing solution out of the reservoir 135 into the stem 115. For example, a click pen may be used. In one aspect, depressing a button at a second end of the bottle 199 may translate the piston 120 towards the bottom face of the reservoir 135. The click-type applicator may utilize a mechanism wherein depressing said button causes a rotation in a rotary cam element (neck 110) thereby moving a screw shaft (stem 115) and moving a piston (piston 120) forward to push out a solution. See U.S. Pat. No. 9,375,068 entitled "CLICK-TYPE APPLICATOR", incorporated herein by reference in its entirety.

Figure 3:
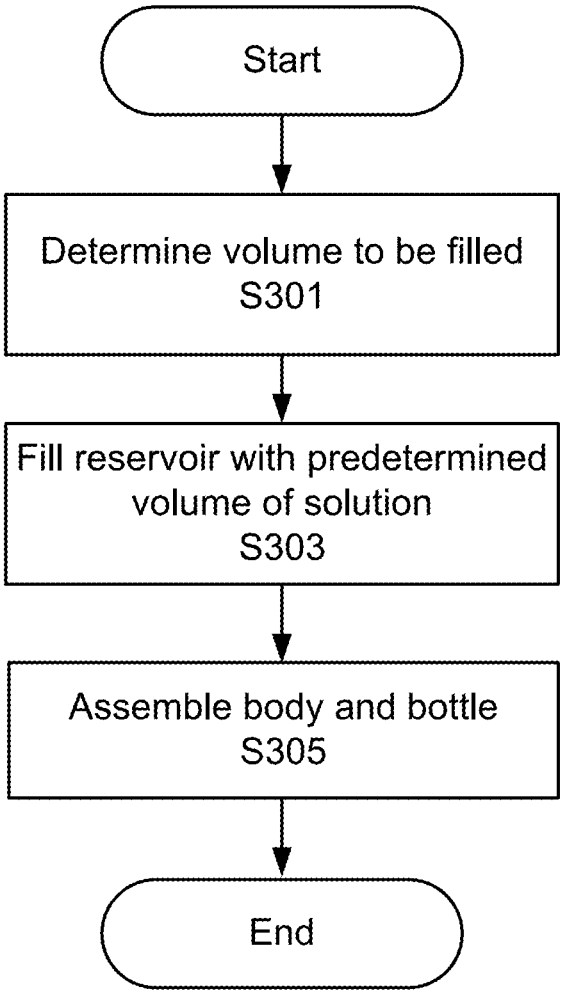
FIG. 3 is a flow chart for a method of assembling a cosmetic flow-through applicator pen, according to an exemplary aspect of the present disclosure.

FIG. 3 illustrates a flow chart for a method of assembling the pen 100, according to an exemplary aspect of the present disclosure. In step S301, the predetermined volume of solution to fill the reservoir 135 is determined, the predetermined volume having an overfilled volume. In step S303, the reservoir 135 is filled with the predetermined volume of solution, wherein the overfilled volume is configured to be displaced and flow out of the reservoir 135 and at least partially into the hollow channel volume of the stem 115. In step S305, the body 198 is inserted into the bottle 199, which in turn displaces the overfilled solution and at least partially into the hollow channel volume of the stem 115.

The over-filling of the reservoir 135 such that the solution is forced into the stem 115, applicator 305, and cap 105 may present multiple advantages. In one advantage, the applicator 305 may have solution already soaked into material applied to the surface of the applicator 305 (e.g. flocking, bristles, etc.) and the pen 100 is ready for use upon first opening. This may present a convenience feature for users since rotation of the neck 110 is not required to immediately use the product. In one advantage, the applicator 305 is soaked in the solution and no air is present to dry out the material applied to the surface of the applicator 305 or dry out solution partially filled in the stem 115. In one advantage, the lack of air in the cap 105 prevents bacterial growth in the solution. In one advantage, the lack of air decreases the rate of drying of the applicator 305 which may permit use of more volatile solvents.

A number of implementations have been described. Nevertheless, it will be understood that various modifications may be made without departing from the spirit and scope of this disclosure. For example, preferable results may be achieved if the steps of the disclosed techniques were performed in a different sequence, if components in the disclosed systems were combined in a different manner, or if the components were replaced or supplemented by other components.

The foregoing discussion describes merely exemplary embodiments of the present disclosure. As will be understood by those skilled in the art, the present disclosure may be embodied in other specific forms without departing from the spirit or essential characteristics thereof. Accordingly, the disclosure is intended to be illustrative, but not limiting of the scope of the disclosure, as well as the claims. The disclosure, including any readily discernible variants of the teachings herein, defines in part, the scope of the foregoing claim terminology such that no inventive subject matter is dedicated to the public.

The invention claimed is:

1. A flow-through system, comprising:

a body, including:

a stem, and an applicator including an interior applicator volume; and a bottle including a reservoir configured to hold a solution, wherein the stem is disposed at a second end of the body and includes a hollow channel volume for the solution to flow through, and is configured to insert into the reservoir through an opening of the reservoir at a first end of the bottle, and when the stem is inserted into the reservoir during a coupling process of the body and the bottle, the hollow channel volume of the stem is configured to be filled with the solution in the reservoir and displace an original volume of the solution in the reservoir by a predetermined amount after the coupling process is complete, and the applicator is attached at a first end of the body and coupled to the stem, and is configured to dispense the solution filled through the stem, the body further comprising:

a cap;

a neck; and a piston, wherein the cap is removeably attached to the second end of the body adjacent to the neck, is configured to cover the applicator when attached, and includes an interior cap volume for the solution to fill, the stem is attached to the neck, the piston is attached to the stem at a position that is completely external to the neck and at a predetermined distance along a length of the stem away from a bottom face of the reservoir when the stem is inserted into the reservoir, forms a seal with a sidewall of the reservoir, and is configured to displace the solution filled in the reservoir into the hollow channel volume of the stem, and the neck is configured to rotate the attached stem, the rotation causing a movement of the piston along a direction of the length of the stem to push the solution from the reservoir into the stem.

2. The flow-through system of claim 1, wherein the hollow channel volume of the stem, the reservoir, and the applicator are configured such that the predetermined amount of the displaced volume of the solution in the reservoir completely fills the hollow channel volume of the stem and the interior applicator volume of the applicator.

3. The flow-through system of claim 1, wherein the hollow channel volume of the stem, the reservoir, the applicator, and the cap are configured such that the predetermined amount of the displaced volume of the solution in the reservoir fills the hollow channel volume of the stem, the interior applicator volume of the applicator, and the interior cap volume of the cap.

4. The flow-through system of claim 1, wherein the reservoir is configured to be filled with the solution which includes at least one selected from the group consisting of mascara, hair gel, eyebrow gel, lip gloss, concealer, liquid blush, and pigmented ink.

5. The flow-through system of claim 1, wherein the applicator is flocked with a flocking material configured to spread the solution onto a surface.

6. The flow-through system of claim 1, wherein the applicator comprises a plurality of bristles configured to brush the solution onto a surface.

7. The flow-through system of claim 1, wherein the stem includes a screw threaded exterior surface, the piston includes a screw threaded interior surface, the screw threaded interior surface of the piston is mounted on the screw threaded exterior surface of the stem, and rotating the neck rotates the screw threaded exterior surface of the stem which translates the piston via the screw threaded interior surface of the piston.

8. The flow-through system of claim 1, wherein an outer diameter of the piston is equal to the diameter of the opening of the reservoir.

9. A body for a flow-through system that is configured to couple with a bottle including a reservoir configured to hold a solution, comprising:

a stem; and an applicator, wherein the stem is disposed at a second end of the body and includes a hollow channel volume for the solution to flow through, and is configured to insert into the reservoir through an opening of the reservoir at a first end of the reservoir, and when the stem is inserted into the reservoir during a coupling process of the body and the bottle, the hollow channel volume of the stem is configured to be filled with the solution in the reservoir and displace an original volume of the solution in the reservoir by a predetermined amount after the coupling process is complete, and the applicator is attached at a first end of the body and coupled to the stem, and is configured to dispense the solution filled through the stem;

the body further comprising:

a cap;

a neck; and a piston, wherein the cap is removeably attached to the second end of the body adjacent to the neck, is configured to cover the applicator when attached, and includes an interior cap volume for the solution to fill, the stem is attached to the neck, the piston is attached to the stem at a position that is completely external to the neck and at a predetermined distance along a length of the stem away from a bottom face of the reservoir when the stem is inserted into the reservoir, forms a seal with a sidewall of the reservoir, and is configured to displace the solution filled in the reservoir into the hollow channel volume of the stem, and the neck is configured to rotate the attached stem, the rotation causing a movement of the piston along a direction of the length of the stem to push the solution from the reservoir into the stem.

* * * * *